United States Patent [19]

Manizza

[11] 4,332,325

[45] Jun. 1, 1982

[54] BOTTLE PACKAGE WITH PROMOTIONAL CARD INSERT

[75] Inventor: Guelfo A. Manizza, Blauvelt, N.Y.

[73] Assignee: Federal Paper Board Company, Inc., Montvale, N.J.

[21] Appl. No.: 243,061

[22] Filed: Mar. 23, 1981

Related U.S. Application Data

[63] Continuation-in-part of Ser. No. 184,639, Oct. 8, 1980.

[51] Int. Cl.[3] ..... B65D 75/54; B65D 77/24

[52] U.S. Cl. ..... 206/216; 206/158; 206/459

[58] Field of Search ..... 206/216, 158, 459; 229/40

[56] References Cited

U.S. PATENT DOCUMENTS

| | | | |
|---|---|---|---|
| 2,996,180 | 8/1961 | Bruce | 206/459 |
| 3,139,094 | 2/1979 | Berry et al. | 206/158 |
| 3,432,029 | 3/1969 | Brown | 229/40 |

*Primary Examiner*—William T. Dixson, Jr.
*Attorney, Agent, or Firm*—FitzGibbon, Roehrig, Greenawalt & Gilhooly

[57] ABSTRACT

A promotional card of paperboard is provided for incorporating in a package of stubby type bottled products which are disposed in double row transversely paired relation and held in a group by a plastic shroud or plastic shrink wrap, which card has a top panel generally with apertures for receiving capped portions of the bottles and for seating beneath the bottom edges of the cap skirts and snuggly engaging the outermost top portions of the bottles, the card being in the form of a flat foldable or formable blank which is trapped beneath the shroud or wrap and which is cut and scored to fit over a center pair of capped bottles with outer end portions conforming generally to interior face portions of the shroud or wrap and extending a portion of the distance down the outer sides of the bottles and when employed with the shroud terminating adjacent bottom edges of the shroud.

5 Claims, 6 Drawing Figures

BOTTLE PACKAGE WITH PROMOTIONAL CARD INSERT

This application is a continuation-in-part of Application Ser. No. 184,639 filed Oct. 8, 1980.

BACKGROUND OF THE INVENTION

This invention relates to packaging and is more particularly concerned with improvements in carrier packages for an assembly or group of articles in the form of bottles which are secured in grouped arrangement by means of a cap gripping plastic shroud or plastic shrink wrap and is more particularly concerned with an improved arrangement in which there is incorporated in the package a promotional card insert of paperboard or similar foldable sheet material.

In a recently developed packaging arrangement for marketing a group of so-called stubby type beverage bottles the bottles are disposed in double line and transversely paired relation and a plastic shroud having a top panel, with openings for the bottle necks and depending peripherial sidewall portions, is forced down over the tops of the bottles and into relatively tight engagement with top portions of the bottles, the sidewall portions being molded or shaped in part to conform to portions of the bottles at the outside periphery of the group and the bottom margin of the shroud being in part in the form of a relatively narrow band which is of generally rectangular configuration with rounded corners which encircle in part the bottles at the four corners of the group. In another arrangement of like character the bottles are retained in group arrangement by a shroud or bonnet of somewhat different construction. In this form portions of the top panel and the depending side wall portions are cut away in part leaving relatively large apertures and providing a top gripping bonnet having the appearance of a lattice work, which enables large portions of the bottom tops to be observed without disturbing the bonnet. In still another form of the bottle package the group of bottles are positioned in a length of plastic tubing or a plastic sheet or strip is wrapped completely around the top, bottom and sides of the group with its ends secured and thereafter the plastic is heat shrunk to tightly enclose the bottles. In some packages of this type it has been found desirable to first place over the top of the assembly of bottles a paperboard cover preferably with finger gripping holes shown in U.S. Pat. No. 3,747,749 dated July 24, 1973.

While the shroud or wrapper in this type package is wholly or partially transparent it may cover a goodly portion of the areas of the bottles normally visible to the customer and reduces the areas available for product identification, advertising and promotional material which, as a practical matter, cannot be incorporated in the shroud or wrapper itself in a satisfactory manner. Consequently, there has developed a desire, on the part of the bottlers and others involved in the marketing of bottled products, for an inexpensive addition to the package to provide for advertising or promotional material so as to enable the package to be made more competitive with other bottle packaging arrangements.

SUMMARY OF THE INVENTION

It is therefore a general object of the invention to provide a relatively inexpensive insert for incorporation in the package described which can serve a variety of product identification, advertising and/or promotional purposes.

It is a more specific object of the invention to provide an insert for a package of the type described which is in the form of a paperboard card cut and creased so as to enable it to be readily positioned on the group of bottles and applied without interfering with the normal application of a top gripping and encasing shroud or bottle enclosing wrapper.

It is a further object of the invention to provide in a bottle package of the type described an insert in the form of a card of foldable sheet material, such as, cardboard or like material, and capable of being cut to a variety of configurations for application to the tops of a portion of the bottles so as to nest within the shroud and conform at its opposite ends, at least in part, to the inside contour of the shroud or wrapper where it is visible but inaccessible for removal until the package is at least partially disassembled.

The invention which is herein described and claimed comprises a package for articles in the form of bottles which comprises an assembly of articles disposed in double row and transversely paired arrangement with a package forming plastic wrapper forming member having a top panel with apertures to receive the bottle necks and a depending skirt formation encompassing in tight engagement top portions of the articles below the necks thereof and an insert in the form of a card of foldable sheet material having a top panel with a pair of apertures for receiving the neck portions of a central pair of the articles and end portions which lie on the interior face of the skirt formation.

The foregoing and other objects and advantages of the invention will become more apparent when reference is made to the accompanying detailed description of the preferred embodiments of the invention which are set forth in the accompanying drawings wherein like reference numerals indicate corresponding parts throughout.

DESCRIPTION OF THE PREFERRED EMBODIMENTS

Figure 1:
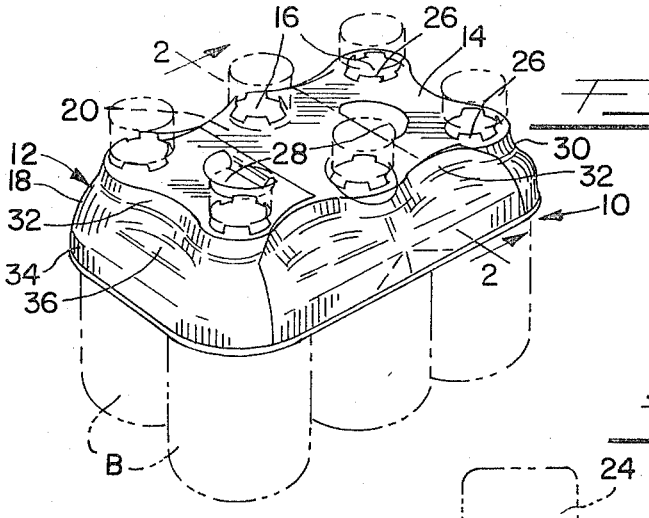
FIG. 1 is a perspective view of a six bottle package which embodies the principle features of the invention, with the bottles being shown in phantom line.

Referring to the drawings there is illustrated in FIG. 1 a bottle package 10 wherein a group of six bottles B are arranged in double row transversely paired relation and held in group forming relation by a shroud, or bonnet, 12 which is formed of a transparent, or semi-transparent, plastic material adapted to be shaped by molding or thermoforming so as to provide a top panel 14 having apertures 16 arranged in pairs for receiving the capped tops of the bottles and a depending skirt formation 18 extending about the peripherial edge of the top panel 14. An insert in the form of a paperboard card 20 is apertured to straddle the center pair of bottle necks and is seated against portions of the inner face of the shroud 12 so as to be locked in place by the latter.

Figure 2:
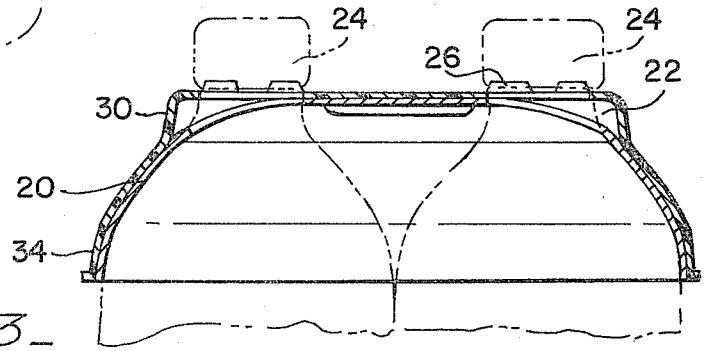
FIG. 2 is a cross sectional view to an enlarged scale, taken on the line 2—2 of FIG. 1, and with the lower portions of the bottles being broken away.

In the form of the package which is illustrated in FIG. 1 the bottles B are the short neck type, generally referred to as "stubbies," with a very small neck portion 22 (FIG. 2) terminating at a mouth which may have a screw on, or pressed on, cap 24. The shroud 12 is apertured and specially designed, or shaped, to be forced down over the caps 24 and snugly engage outermost areas of the neck and adjoining top portions of the bottles B with maximum engagement of the bottle areas at the four corners of the group or assembly thereof. The top panel 14 of the shroud 12 has the apertures 16 arranged and spaced according to the bottle arrangement and spacing with each aperture 16 being of a size to accommodate the cap 24 and having inwardly projecting peripheral spaced bendable lug formations 26 which are adapted to engage beneath the bottom edge of the skirt of the associated cap 24. A pair of finger apertures or holes 28, located in the space between the bottles, affords a convenient means for picking up the package. The skirt formation 18 of the shroud 12 is shaped to provide a narrow band formation 30 at the periphery of the top panel 14 which is bowed inwardly in the areas between the bottles as indicated at 32. A narrow band formation 34 forms the bottom margin of the shroud 12 which is of rectangular formation and tightly grips an appreciable area at the top portions of the corner bottles while bridging the space between the same and engaging a sufficient area of the outboard portions of the center pair of bottles to hold them in the group arrangement. The material between the band formations 30 and 34 tapers downwardly and outwardly and conforms to the general shape of the top outboard portions of the bottles with inward bowing between the bottles in the same manner as the top band formation 30, as indicated at 36. At the corners the shroud 12 hugs the bottle surfaces and the top of the bottom band formation 34 merges with adjoining portions of the shroud wall.

Figure 3:
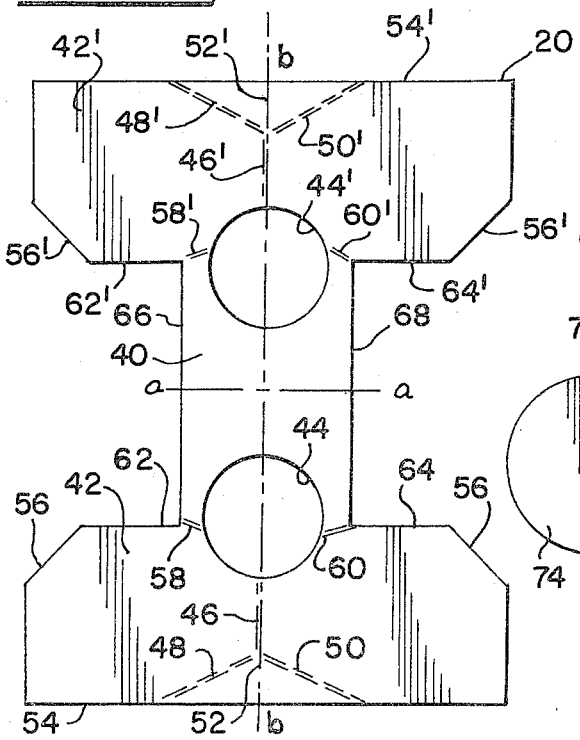
FIG. 3 is a plan view of a card insert which is cut and scored for insertion in the package of FIG. 1.

The insert 20, as shown in FIG. 3, is formed from a paperboard sheet of relatively light gauge which is cut in a generally H-shaped configuration so as to provide a small rectangular center panel 40 with cross panels 42, 42' at opposite ends. The insert is symmetrical about a center line a—a and the panel 40 has sufficient width dimension to accommodate identical bottle neck accommodating apertures 44, 44' which are equally spaced from the center line a—a and extend into the cross end panel portions 42, 42'. The apertures 44, 44' are elliptical in shape as shown for reasons hereafter described and are spaced according to the spacing of the middle pair of bottles in the group. The end panel portions 42, 42' are generally rectangular and are dimensioned in the direction parallel with the center line a—a so as to provide substantial display areas. In the form shown, when in place in the package, the end panels 42, 42', which are adapted to lie beneath the sidewall of the shroud 12, extend approximately between the vertical centers of the end bottles or corner bottles in the group. To facilitate bending of the panel end portions 42, 42' to conform to the shroud wall configuration these panels are scored and cut on a center line b—b which is normal to the center line a—a. Scores 46, 46' extend from the apertures 44, 44' to the intersections of pairs of outwardly diverging score lines 48, 50 and 48', 50' and cutting lines 52, 52', with the latter extending to the outboard edges 54, 54' of the panels. The panels 42, 42' are cut away at their inboard outermost corners as indicated at 56, 56'. In addition small score lines 58, 60 and 58', 60' extend from the periphery of the apertures 44, 44' to the inboard edges 62, 64 and 62', 64' where they intersect the side edges 66, 68 of the center panel 40.

Figure 4:
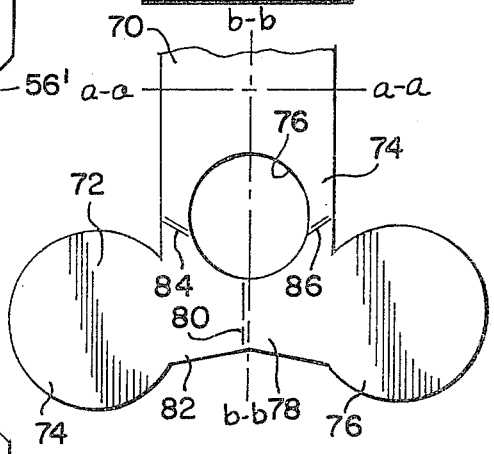
FIG. 4 is a partial plan view of a card insert which is cut to provide a somewhat different configuration.

A modified insert 70 is illustrated in FIG. 4 which is provided with end or side panels 72 having a somewhat different panel configuration. In this form the center panel 74 may be substantially the same as the panel 40 in FIG. 4, with a pair of bottle neck receiving apertures 76 disposed on opposite sides of a center line aa—aa and properly spaced according to the bottle size, spacing and arrangement. The end or side panels 72 are each cut in the form of two circular portions 74 and 76 with a center joining panel portion 78 outboard of the aperture 76 which joining portion 76 is divided by a cutting line 80 with the latter extending from the aperture 76 to the outboard edge 82 of the panel 72. The edge 82 is notched out between the two circular panel portions 74 and 76 as shown. In a typical use the circular portions 74 and 76 may be printed with the picture or pictures of an athletic figure or figures, or they may serve as discount coupons to induce repeat buying of the product or purchase or other products. At the inboard edges the panels 72 are provided with scores 84 and 86 corresponding to the scores 58 and 60 in FIG. 3 for the same purpose, that is, to facilitate bending and conforming to the inside face of the shrunken plastic wrapper or shroud member so as to insure visibility of any printed matter on the surface.

The inserts 20 and 70 are shaped and dimensioned so as to enable the application of the same to the bottle group without interference with the application of the shroud 12, either separately, or simultaneously with the shroud 12, by means of appropriate apparatus.

Figure 5:
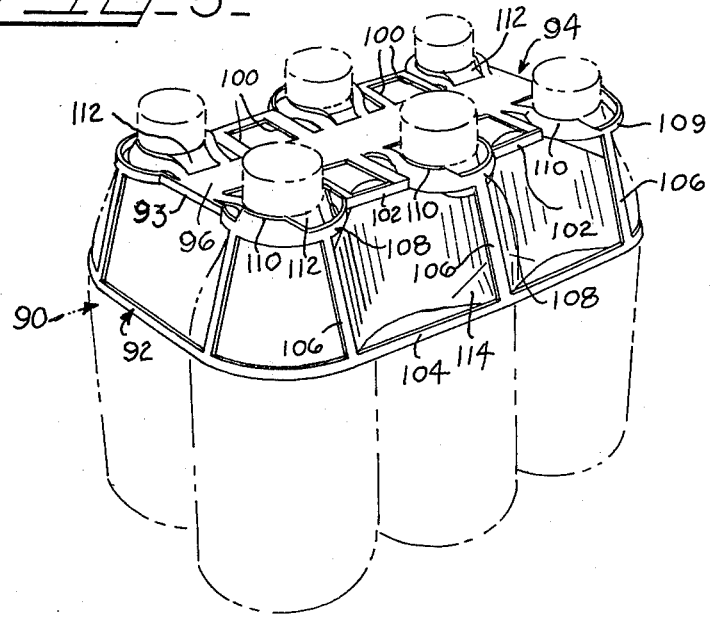
FIG. 5 is a perspective view of a bottle package having a modified form of bottle gripping shroud.

In FIG. 5 there is illustrated a package 90 with the bottles confined in a group by a plastic shroud or bonnet 92 which is somewhat different in appearance and structurally from that of the shroud 12 of FIG. 1 but which has the same general configuration and performs the same purpose. While the shroud 12 in FIG. 1 is substantially imperforate, except for the cap receiving and gripping apertures 16, the bottles in the package 90 are gripped and held in the same manner by the shroud 92 which may be plastic molded or thermoformed with certain relatively large areas missing so that the entire shroud has a skeleton or lattice work appearance with relatively large apertures in the depending side and end wall formations. The shroud 92 has a top longitudinal, central panel 94 which comprises an elongate imperforate strip panel 96 which extends end-for-end of the package to an integral connection with portions of a narrow band formation 98 which extends about the margin of the top panel 94 and which is integrally connected to the longitudinal panel 94 by a series of peripherally spaced narrow strut formations 100 which extend outboard of the central panel in a general normal direction and in the plane of the central panel 96 and integrally join the circumferential band 98. The circumferential band 98 has portions, indicated at 102, which are offset inwardly of the top panel so that adjoining portions extend outboard of the faces of the bottles and provide a limitation to the outward movement of the tops of the bottles. This also provides holes for receiving the tops of the bottles which are aligned according to the transverse and longitudinal alignmet of the bottles. Portions of the top band formation 98 are integrally joined to a lower band formation 104 which tightly encircles the bottle assembly in the vicinity of the top of the main body of the bottles. The top and bottom band formations 98 and 104 are integrally joined by a plurality of outwardly and downwardly directed strut formations indicated at 106. The struts 106 extend from portions 108 of the top band formation 98 which extend outboard of the top portions of the necks of the bottles and which have widened and turned in portions 110 properly positioned to engage in gripping relation under the skirts of the bottle caps, the top panel area at these points being formed so as to provide bottle top receiving apertures 112.

The insert panel 114 (FIG. 5) may correspond to the panel 20 illustrated in FIG. 3 with appropriate change in size or relative dimensions and information to fit the particular product with the end display panels configured and dimensioned to be visible between the vertical struts 106 which lie on the outside faces of the center and end bottles in the rows with the end panels of the insert extending on each side of the middle bottle to approximately the middle of each of the end bottles so as to afford maximum display of the material on the end panels of the card insert.

The insert 114 may, of course, be incorporated in the package in the same manner as set forth with respect to the insert 20 in the package of FIG. 1 while the package is being assembled.

Figure 6:
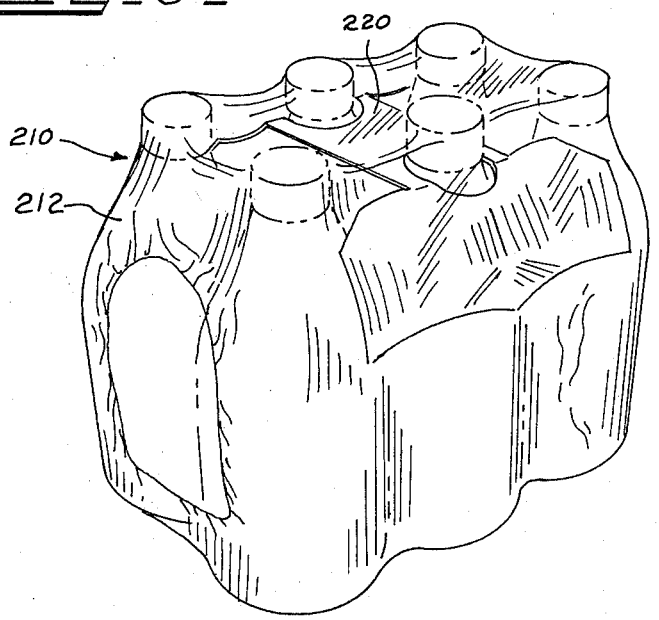
FIG. 6 is a perspective view of a bottle package in which the bottles and card insert are confined by a plastic shrink wrap.

In FIG. 6 there is illustrated a bottle package 210 in which a card insert 220 is incorporated when the packaging material comprises a well known plastic shrink wrap. In this form of the package the bottles are grouped or assembled in double row and transversely paired alignment and positioned in a section of transparent or semi-transparent tubing 212 of somewhat larger size then required to accept the group of bottles with the card insert 220 properly positioned on the middle pair of bottles. Alternatively, the assembly of bottled products and the card insert may have a relatively thin plastic film wrapped about the top, sides and bottom of the assembly. In either arrangement the film or tube material has been treated to give it the required bi-axial characteristics for shrink purposes and is applied to take advantage of such characteristics in obtaining a tight wrapped package by subjecting it to the proper temperature in an oven to shrink the material about the assembly. Shrink-wrap plastic sheet material suitable for this purpose and the method of applying the same is fully described in U.S. Pat. No. 3,747,749. Preferably, the card insert 220 is of the construction shown in FIG. 3 or 4 with the elements of the proper size and configuration appropriate for the particular bottled product. The assembly is then subject to the proper heat to shrink the plastic about the assembly to the extent that it clings to and takes the form of the outside faces of the assembly to produce the package of FIG. 6. The card insert conforms approximately to the inside face of the shrink wrap material.

It will thus be seen that the present invention provides a novel package for bottles or the like held in place by a carrier which includes means for positioning a promotional card or other enclosure, such package having several desirable advantages and characteristics, including those specifically pointed out herein and others which are inherent in the invention.

Preferred embodiments of the invention having been shown by way of illustration, it is anticipated that variations in the exact form of the packaging shown may be made by those skilled in the art without departing from the spirit of the invention or the scope of the appended claims.

What is claimed:

1. An article package comprising a group of articles having the general form of relatively short neck bottles with cap type closures, which articles are arranged in double row transversely paired relation and held in group arrangement by a shroud formed of a continuous plastic which is at least semi-transparent and which is shaped or otherwise formed so as to provide a top wall forming panel and a depending sidewall formation extending about the perimeter of the top wall forming panel, said top wall forming panel engaging portions of the cap closures, said sidewall formation extending downwardly in tightly gripping relation to top portions of the articles and having a depth which extends below at least to the bottom of the neck forming portions of the articles with a peripherial dimension which results in tightly gripping outboard portions of the surfaces of the corner articles in the group, and a promotional display card of bendable sheet material trapped between the shroud and the top portions of the articles, which display card has a center panel extending transversely relative to the articles, said center panel having spaced apertures adapted to accommodate the neck portions of the middle row of articles and panel formations at opposite ends of the center panel which extend downwardly along at least a portion of the sidewall formation and which lie in close proximity to the inner face of the sidewall formation so that display material on the surface is visible through the shroud material, said panel formations having a dimension formation greater than the dimension of said center panel relative to the sidewall formation.

2. In a package comprising a plurality of articles having the general shape of short neck beverage bottles which are disposed in double row and transversely paired relation, and a plastic article gripping and package forming shroud member which includes an aperture top panel for engaging top portions of the articles and a depending skirt formation extending in gripping relation about portions of the articles which adjoin the neck portions, said shroud formation having major portions at least semi-transparent so that underlying material is readily visible, a display card having a central top panel portion with a pair of apertures transversely spaced according to the spacing of a center pair of the articles and configured to receive the article neck portions and having end panel portions of greater dimension than the central panel portion in the direction of the rows of the articles and folded down along the outside perimeter of the articles so as to be located closely adjacent to the inner surface of the skirt portion of the shroud member, and the display card has end panel portions which are scored so as to be bendable on a transverse centerline and thereby enabling the end portions to assume a shape conforming to the inner face portions of the overlying skirt portion of the shroud member.

3. In a package set forth in claim 2 wherein the display card is dimensioned so that the dimension thereof transversely of the group of articles corresponds approximately to the corresponding dimension of the shroud member.

4. In a package as set forth in claim 2 wherein the transverse end margins of the display card terminate on lines which extend appreciably below the bottom margins of the skirt of the shroud member.

5. In a package as set forth in claim 2 wherein the display card has a pair of apertures of sufficient size to receive capped articles and inwardly extending lug members on the periphery of each aperture which extend inwardly a sufficient distance to engage beneath the bottom edge of the skirt of a cap on the mouth of the article seated therein.

* * * * *